United States Patent [19]

Light

[11] 4,013,464

[45] Mar. 22, 1977

[54] PHOTOCONDUCTIVE AND RADIOCONDUCTIVE COMPOSITIONS AND ELEMENTS CONTAINING TETRAGONAL LEAD MONOXIDE

[75] Inventor: William A. Light, Rochester, N.Y.

[73] Assignee: Eastman Kodak Company, Rochester, N.Y.

[22] Filed: Dec. 3, 1975

[21] Appl. No.: 637,422

[52] U.S. Cl. ..... 96/1.5; 252/501; 346/160

[51] Int. Cl.[2] ..... G03G 5/04

[58] Field of Search ..... 96/1.5, 1.6; 252/501; 346/74 P

[56] References Cited

UNITED STATES PATENTS

| | | | |
|---|---|---|---|
| 3,008,825 | 11/1961 | Van Dorn et al. | 96/1.5 |
| 3,406,063 | 10/1968 | Matkan et al. | 96/1.5 |
| 3,488,189 | 1/1970 | Mayer et al. | 96/1.5 |
| 3,577,272 | 5/1971 | Reithel | 96/1.5 |
| 3,607,261 | 9/1971 | Amidon et al. | 96/1.5 |
| 3,929,478 | 12/1975 | Curtin | 96/1.5 |

*Primary Examiner*—David Klein
*Assistant Examiner*—Judson R. Hightower
*Attorney, Agent, or Firm*—R. P. Hilst

[57] ABSTRACT

Photoconductive and radioconductive insulating compositions of desirably low dark conductivity and improved resistance to fatigue include tetragonal lead oxide, a binder of polyvinylacetate, polyvinylformal and/or polyvinylbutyral and a small effective amount of an anhydride capable of inhibiting dark conductivity in the composition, particularly under repeated use. Preferred anhydrides are phthalic and maleic anhydrides in an amount of less than about 4 percent of the weight of lead oxide in the composition. Such compositions can be carried on an electrically conductive support to provide elements that are useful for electrophotographic and electroradiographic imaging.

9 Claims, No Drawings

PHOTOCONDUCTIVE AND RADIOCONDUCTIVE COMPOSITIONS AND ELEMENTS CONTAINING TETRAGONAL LEAD MONOXIDE

FIELD OF THE INVENTION

1. Background of the Invention

The present invention relates to electrography and particularly to electrophotography and to electroradiography (xeroradiography). The process of electrophotography or of electroradiography uses an element generally having a support material bearing a coating of a normally insulating material whose electrical resistance varies with the amount of incident light radiation or X-radiation it receives during an imagewise exposure. The element, commonly termed a photoconductive element, is first given a uniform surface charge. It is then exposed to a pattern of light or X-radiation which has the effect of differentially reducing the potential of this surface charge in accordance with the relative energy contained in various parts of the radiation pattern. The differential surface charge or electrostatic latent image remaining on the electrophotographic, xeroradiographic element is then made visible by contacting the surface with a suitable electroscopic marking material. Such marking material or toner, whether contained in an insulating liquid or on a dry carrier, can be deposited on the exposed surface in accordance with either the charge pattern or in the absence of charge pattern as desired. Deposited marking material can then be either permanently fixed to the surface of the sensitive element by known means such as heat, pressure, solvent vapor, or the like, or transferred to a second element to whcih it can similarly be fixed. Likewise, the electrostatic latent image can be transferred to a second element and developed there.

2. Description of Related Art

Various photoconductive insulating materials have been employed in the manufacture of electrographic elements that are sensitive to light, including ultraviolet rays, and to X-radiation. For example, inorganic materials such as amorphous selenium, cadmium sulfide, zinc sulfide and sulfur, and organic materials such as anthracene and stilbene coated on a suitable support are sensitive to X-rays.

A particularly useful material having such capability is tetragonal lead monoxide which hereinafter, unless expressly noted to the contrary, will be referred to as lead oxide. The high light sensitivity of lead oxide to visible light was described in U.S. Pat. No. 3,008,825 (issued Nov. 14, 1961), where photoconductive insulating compositions having dispersions of lead oxide in various electrically insulating binders were indicated. A wide variety of organic, polymeric binders were discussed, including such materials as acrylic and methacrylic acid esters, vinyl polymers like polystyrene and polyvinylacetate, etc. Optionally, the binders could be plasticized for improvements in adhesion, flexibility, etc; preferred plasticizers were not specified.

U.S. Pat. No. 3,406,063 (issued Oct. 15, 1968) describes the use in photoconductive insulating compositions of organic, nonpolymeric crystalline substances that are not film-formers. The nonpolymeric substances are used as an alternative to polymeric resin binders and are usable without curing. It is asserted that such nonpolymeric materials impart a more uniform charge holding capacity to a photoconductive insulating layer than do polymeric binders. Among the photoconductors described is tetragonal lead monoxide, and the non-crystalline monomers include organic acids and anhydrides such as phthalic anhydride and maleic anhydride. The anhydrides are described as useful in an amount of from 12 percent to 100 percent of the weight of the photoconductor, with at least 25 percent being typically shown in the examples.

Film-forming binders for photoconductors such as lead oxide are discussed in U.S. Pat. No. 3,488,189, and materials such as polyvinyl acetate, polyesters and polyvinylbutyral are mentioned. In accordance with the disclosure of the U.S. Pat. No. 3,488,189 patent, solid, crystalline plasticizers can be used to advantage in avoidance of toner offset. Anhydrides are not described. The examples show the use only of plasticizer layers separate from the photoconductive layer, and when the plasticizer is used in a layer with photoconductor and binder, higher concentrations are required.

U.S. Pat. No. 3,577,272 describes an improved lead oxide photoconductor and refers to a wide variety of film-forming polymeric binders for such photoconductor. Binders such as polyacrylic and methacrylic esters, polyvinylacetate, polyvinylacetal and polyvinylbutyral are mentioned and Pliolite is cited specifically as a desirable binder.

The aforementioned patents do not, either singly or in combination, allude to problems of increased dark conductivity and fatigue. Further, there is no suggestion that lead oxide when used together with certain binders and certain anhydrides in small amounts, can provide photoconductive insulating compositions that are improved in such respects.

SUMMARY OF THE INVENTION

In accordance with the present invention, there are provided improved photoconductive and radioconductive insulating compositions that include photoconductive and/or radioconductive lead oxide (preferably monoxide), an electrically insulating binder that is one or more of polyvinylacetate, polyvinylformal or polyvinylbutyral and, in a small effective amount (i.e., effective to maintain low dark conductivity in the composition), an anhydride capable of inhibiting increases in dark conductivity, particularly on reuse of the composition. The compositions of this invention can be applied to an electrically conducting support to provide a photoconductive and radioconductive element that can be charged, exposed and processed as discussed elsewhere herein to yield an electrostatic latent image or visible image corresponding to an electrostatic latent image. With compositions and elements of this invention, repeated charge and expose cycles can be carried out rather rapidly without unacceptable increases in dark conductivity, which would be manifested as fatigue, an inability to maintain a sufficient electrostatic charge for re-imaging purposes.

DESCRIPTION OF PREFERRED EMBODIMENTS

In the subject photoconductive and radioconductive insulating compositions, although any photoconductive and/or radioconductive lead oxide can be used, tetragonal lead oxide is preferred. For use in the present invention, tetragonal lead oxide can be prepared by the heat treatment of particulate orthorhomibic lead monoxide in an aqueous suspension, as described in U.S. Pat. No. 3,577,272. Such treatment provides a lead oxide in particulate form that demonstrates high speed, especially when exposed to X-radiation, i.e., electromagnetic radiation having a wavelength of from about 0.1 angstrom to about 100 angstroms. The lead oxide materials as generally used in this invention are of an average particle size (diameter) between about 0.25 micron to about 10 microns.

As mentioned previously, the binder used in the present compositions and elements together with the lead oxide and anhydride is either a polyvinylacetate, a polyvinylformal or a polyvinylbutyral, which can be used singly or in any combination. Although such film-forming polymers are within the resinous binders often described as useful for preparing photoconductive insulating compositions, as will be demonstrated hereinafter, they provide, in the subject compositions, unique benefits not seen with other well known polymeric binders such as styrene-butadiene copolymers.

Polyvinylacetates preferred herein are those having more than about 50 percent acetyl groups. Especially preferred binders are polyvinylformal and polyvinylbutyral materials. A wide variety of such polymers can be used to advantage, and in general such binders will have from about 5 to 10% polyvinyl alcohol groups, about 2 to 50% polyvinylacetate groups and the remaining 40 to 93% formal or butyral groups. Representative polyvinylformals and polyvinylbutyrals are such materials as Formavar 7/70 (5% polyvinyl alcohol and 40 to 50% polyvinylacetate, marketed by Monsanto), Formavar 12/85 (5 to 7% polyvinylalcohol and 20 to 27% polyvinylacetate), Formavar 7/95 "S" (7 to 9% polyvinylalcohol and 9.5 to 13% polyvinylacetate), they being polyvinylformals, and the polyvinylbutyral Butvar B-76 (9 to 13 percent polyvinylalcohol and 2.5% polyvinylacetate).

Together with the lead oxide and film-forming polymeric binder as described herein, the present photoconductive or radioconductive compositions include a small, effective amount of an anhydride capable of inhibiting increases in dark conductivity in the compositions, such as under conditions of repeated use. As used herein, the term "effective amount" refers to an amount of anhydride that provides, when using a composition of this invention, a second cycle ratio of photodecay to dark decay greater than such ratio of a similar composition, but without the anhydride. The determination of second cycle dark decay and photodecay is made according to the procedure described in Examples 1 through 3 below. Whether a particular anhydride possesses such a capability can be demonstrated conveniently by preparing an electrophotographic element as described hereinafter wherein the photoconductive insulating coating contains 10 parts (by weight) tetragonal lead monoxide of appropriate particle size, 1 part Formavar 12/85 binder and from 0.1 to 0.3 parts of the anhydride. The test element can be compared against a similar element, but omitting the anhydride, by repeatedly (at least five times) charging each to a positive surface potential of approximately 400 volts, holding each under dark conditions for 30 seconds, and then exposing each to 1 footcandle of 3000° K tungsten light for 50 seconds. Approximately 30 seconds is allowed between the exposure of a cycle and the charging of the next cycle for dark adaptation of the composition. The surface potential of each element in exposed and unexposed regions is monitored during each cycle. If the anhydride is inhibiting dark conductivity, the surface potential in regions of prior exposure, at the end of the hold period during each cycle, will be greater than the corresponding surface potential for the control element (lacking the anhydride).

Unexpectedly, it has been discovered not only that certain anhydrides are effective for inhibiting dark conductivity as described herein, especially under conditions of repeated use, but also that such effectiveness is demonstrated as a practical manner only when the anhydride is used in a small amount, usually less than about 4% of the weight of lead oxide. Preferred anhydrides are those derived from $\alpha,\beta$-dicarboxyl substituted compounds, such as $\alpha,\beta$-dicarboxylic acids, or $\alpha$-carboxyl-$\beta$-hydroxy substituted compounds, such as $\alpha$-hydroxy-$\beta$-carboxylic acids. Such compounds can be either aliphatic or aromatic in nature. Representative of the anhydrides useful herein are maleic anhydrides, phthalic anhydrides such as phthalic anhydride, tetrabromophthalic anhydride, 3-nitrophthalic anhydride, naphthalic anhydride and 3,3′,4,4′-benzophenonetetracarboxylic dianhydride. The mechanism by which the anhydride inhibits dark conductivity is not completely understood, but it is believed that, in some way, it neutralizes chemisorbed oxygen on the surface of the lead oxide.

Compositions and elements in accordance with the present invention can be prepared by dispersing the lead oxide in a solution of the binder and anhydride. The solvent of choice for preparing the composition in any instance will vary, but solvents such as benzene, toluene, acetone, 2-butanone, alcohols such as lower alkanols, chlorinated hydrocarbons like dichloromethane, 1,2-dichloroethane, etc, can be used singly or in appropriate combinations. In preparing photoconductive and radioconductive insulating compositions as described herein, the binder concentration is widely variable. Usually, it ranges from about 5% to about 50% of the weight of lead oxide. As mentioned previously, the anhydride usually ranges from about .5% to about 4% of the lead oxide weight. Total solids in a liquid coating composition is also variable in keeping with common practice, but generally will vary from about 25% to about 60% of the composition's weight. If the lead oxide particle size as dispersed is excessive, the coating composition can be ball-milled as desired.

To prepare elements that demonstrate electrophotographic and electroradiographic capability, a photoconductive and radioconductive insulating composition as discussed herein is applied to a support material. The coating of the phtoconductive composition on a support can vary widely. Generally, a coating in the range of about 0.025mm to about 2.5mm before drying is useful for the practice of this invention. The preferred range of coating thickness is in the range from about 0.05mm to about 0.5mm before drying although useful results can be obtained outside of this range. When dry, the photoconductive layers usually range from about 5 microns to about 1000 microns, although wider ranges can be desirable.

Suitable supporting materials for coating the photoconductive layers of the present invention can include any of a wide variety of electrically conducting supports, for example, paper (at a relative humidity above 20%); aluminum-paper laminates; metal foil such as aluminum foil, zinc foil, etc; metal plates, such as aluminum, copper, zinc, brass, and galvanized plates; vapor deposited metal layers such as silver, nickel or aluminum and the like on paper and resin film supports. An especially useful conducting support can be prepared by coating a resin film support material such as poly(ethylene terephthalate), cellulose acetate, etc, with a layer containing a semiconductor in a resin. Such conducting layers both with and without insulating barrier layers are described in U.S. Pat. No. 3,245,833. likewise, a suitable conducting coating can be prepared from the sodium salt of a carboxyester lactone maleic anhydride and a vinyl acetate polymer. Such kinds of conducting layers and methods for their optimum preparation and use are disclosed in U.S. Pat. Nos. 3,007,901 and 3,267,807.

The elements of the present invention can generally be employed in either an electrophotographic or an electroradiographic imaging process. In a representative process of either type, the element is given a blanket electrostatic charge by placing the same under a corona discharge which serves to give a uniform charge to the surface of the photoconductive layer. This charge is retained by the layer owing to the substantial insulating property of the layer, that is, the low conductivity of the layer in the absence of activating radiation, which can usually be either visible light, ultraviolet light or x-radiation. The electrostatic charge formed on the surface of the photoconducting layer is then selectively dissipated from the surface of the layer by exposure to a pattern of activating radiation which is to be reproduced so that the irradiated areas discharge by photoconduction. By exposure of the surface in this manner, a charged pattern is created by virtue of the fact that the exposing rays cause the charge to be conducted away in proportion to the intensity of the irradiation in a particular area. The charge pattern remaining after exposure is then developed, i.e., rendered visible, by treatment with a medium comprising electrostatically attractable particles having optical density. The developing electrostatically attractable particles can be in the form of a dust, e.g., powder, pigment in a resinous carrier, i.e., toner, or a liquid developer may be used in which the developing particles are carried in an electrically insulating liquid carrier. Methods of development of this type are widely known and have been disclosed in U.S. Pat. No. 2,397,691 and in Australian Pat. No. 212,315, for example. By selecting a developing particle which has as one of its components, a low-melting resin, it is possible to treat the developed photoconductive material with heat and cause the powder to adhere permanently to the surface of the photoconductive layer. In other cases, a transfer of the image formed on the photoconductive layer can be made to a second support such as paper, which would then become the final print. Techniques of the type indicated are well known in the art and have been described in U.S. Pat. No. 2,297,691 and 2,551,582 and in "RCA Review", Volume 15 (1954), pages 469–484, for example.

Additionally, the electrostatic charge comprising the latent image which is produced on the surface of the photoconductive element after exposure can be transferred to a receiving sheet and developed there. The charging and exposing of the photoconductive element and the transfer of the latent image can occur simultaneously as described in Walkup U.S. Pat. No. 2,825,814.

The compositions and elements described herein are particularly responsive to X-radiation, i.e., radiation having a wavelength from about 0.1 angstrom to about 100 angstroms and are useful in various xeroradiographic applications.

The following examples are included to illustrate further the present invention.

EXAMPLE 1

To prepare a control element, 20 g. of Pliolite S-5 (Styrene butadiene copolymer, Goodyear), 30% solids in toluene; 25.3 ml. of toluene; 3.7 ml. of methyl alcohol; and 30 g. of tetragonal lead oxide were placed in a 120 ml. glass bottle. 30 agate balls approximately 10mm in diameter were added to this mixture, and the mixture was ball milled at approximately 100 rpm for 24 hours. The ball milled dispersion was hand coated using a coating knife at a 0.25mm wet thickness on a support having a 0.4 optical density (OD) nickel layer vacuum deposited on poly(ethylene terephthalate). The coating was dried for 1 hour at room temperature (22° C) and for 16 hours in a laboratory oven at 60° C. The coating's dry thickness was measured as 35 $\mu$. A photoconductive element of the invention (Element A) was prepared in the following manner: 6 g. of Formavar 7/70 (polyvinyl formal resin, Monsanto) and 0.3 g. of phthalic anhydride were dissolved in a solvent mixture consisting of 21.8 ml. of dichloromethane, 15.6 ml. of 1,2-dichloroethane, and 1 ml. of methyl alcohol by stirring the solids in the solvent with a magnetic stirrer for 2 hours at room temperature (22° C). The resulting solution of Formvar 7/70 and phthalic anhydride, together with 30 g. of tetragonal lead oxide and 30 agate balls, was placed in a 120 ml. glass bottle. The mixture was ball milled at approximately 100 rpm for 24 hours. The ball milled dispersion was then coated and dried on the control. The coating's dry thickness was measured as 32 $\mu$. The dark decay and xerographic regenerative properties of the control element were measured by charging the control coating in the dark for 10 seconds to a positive surface potential of 400 V, allowed to dark decay for 30 seconds, then exposed to 1 footcandle of 3000° K tungsten light for 50 seconds. The element's surface potential was monitored throughout the procedure. The charged element dark decayed 45 volts or 11% of its 400 V surface potential. The element photodischarged at a very rapid rate, decaying to 100 V surface potential in less than 1 second. The cycle was repeated allowing 30 seconds for dark adaption after light exposure. The sample did not regenerate. Its dark decay increased drastically to 270 volts or 68% of its 400 V surface potential. The dark decay and xerographic regenerative properties of Element A were measured in the same manner as for the control element. During its initial use, Element A dark decayed 22 volts or 5.5% or its 400 V surface potential. Element A photodischarged at a very rapid rate, decaying to 100 volts surface potential in approximately 2 seconds. During its second use Element A dark decayed 50 volts or 12.5% and photodischarged at exactly the same rate as during its first light exposure. Element A was cycled 25 times and its dark decay increased to only 68 volts or 17% during the 25th use. Its photodischarge rate remained essentially constant during the 25 cycles.

EXAMPLE 2

To prepare a control element, 10 g. of Pliolite S-5, 30% solids in toluene; 28.1 ml. of toluene; 2 ml. of methyl alcohol; and 30 g. of tetragonal lead oxide were placed in a 120 ml. glass bottle. Thirty agate balls were added to this mixture, and the mixture was ball milled at approximately 100 rpm for 24 hours. The ball milled dispersion was filtered through a 100 mesh silk screen.

The filtered dispersion was hand coated at 0.25mm wet thickness on a support having a 0.4 OD nickel layer vacuum deposited on poly(ethylene terephthalate). The coating was air dried for 15 minutes at room temperature. After air drying, a second coating of the same dispersion (0.3mm wet thickness) was applied over the first coating. The two layer coating was air dried for 1 hour at room temperature (22° C) and for 16 hours in a laboratory oven at 60° C. The dry thickness of the coated layers was measured as 86$\mu$. A lead oxide photoconductive element of the invention (Element B) was prepared in the following manner: 3.85 g. of Formvar 12/85 and .39 g. of phthalic anhydride were dissolved in a solvent mixture consisting of 17.9 ml. of dichloromethane, 19.2 ml. of 1,2 -dichloroethane and 1 ml. of methyl alcohol by stirring the solids in the solvent with a magnetic stirrer for 2 hours at room temperature. The resulting solution, together with 38.5 g. of tetragonal lead oxide and 30 agate balls was placed in a 120 ml. glass bottle. The mixture was ball milled at approximately 100 rpm for 24 hours. The ball milled dispersion was filtered through a 100 mesh silk screen and hand coated at a 0.25mm wet thickness on a support having a 0.4 OD nickel layer vacuum deposited on poly(ethylene terephthalate). The coating was air dried for 15 minutes at room temperature (22° C). After air drying a second coating of the same dispersion of 0.3mm wet thickness was applied over the first coating. The two layer coating was air dried for 1 hour at room temperature and for 16 hours in a laboratory oven at 60° C. The dry thickness of the coated layers was measured as 82 $\mu$. The dark decay and xerographic regenerative porperties of the control element were measured as in Example 1, but using negative charging and allowing 1 minute of dark adaption between each use. Initially, the control dark decayed 55 volts or 14% of its 400 V surface potential. It photodischarged at a rapid rate, decaying to 100 volts surface potential in 4.5 seconds. During its second use, dark conductivity of the control increased drastically. It dark decayed 268 volts or 67% of its 400 V surface potential. The dark decay and xerographic regenerative properties of Element B were measured in the same manner as for the control. It was noted that unlike the control, Element B had low dark conductivity and was reusable. Initially, Element B dark decayed 35 volts or 8.7% of its 400 V surface potential. It photodischarged at a rapid rate, decaying to 100 V surface potential in approximately 9 seconds. During its second use, Element B decayed 130 V or 32.5% of its 400 V surface potential. The Formvar coating was cycled 10 times and its dark decay increased only slightly without any change in the shape of its photodischarge curve.

EXAMPLE 3

A portion of the control element and of Element B from Example 2 were used in an electroradiographic mode to make multiple prints. For each print, the element was placed in a face-to-face relationship with a paper receiver sheet having a resinous, electrically insulating surface layer over an electrically conducting layer. The electrically insulating surface of the receiver sheet carried methacrylate beads of about 20 microns in diameter, providing a space of approximately that dimension between the lead oxide and the insulating surface of the receiver when element and receiver sheet were brought into face-to-face contact. A negative polarity d.c. pontential of approximately 3000 volts was applied to the conducting layer of the lead oxide elements and the conducting layer of the receiver sheet was maintained at ground potential. During application of this potential, the lead oxide elements were imagewise exposed through their supports to x-radiation using metal test objects to block the radiation in some areas. The exposures, 21.5 mr. for 15 seconds, were made using a Faxitron model 805 x-ray unit. After exposure, each receiver sheet was separated from the lead oxide element and developed by contacting it with a liquid, electrophotograhic developer composition containing positively charged toner particles to produce a visible image. When using the control element, the first print was of excellent quality. After a 5 minute period of dark adaptation, a second print was made in a like manner. However, the lead oxide composition did not regenerate and the second print was of poor quality, having high background density. When using the portion of Element B, ten excellent quality prints were made, allowing 5 minutes between each use for dark adaptation.

EXAMPLE 4

Elements were prepared in the manner described in Example 2, using a tetragonal lead oxide to binder ratio of 10:1. The binders used were either Pliolite S-5 or Formvar 12/85 and varying concentrations of phthalic anhydride, maleic anhydride and the Lewis acid 2,4,7-trinitro-9-fluorenone were included in the coating formulations, with such concentrations being expressed below as a weight percentage of the tetragonal lead oxide in that composition. Each of the elements was coated as described in Example 2 at a wet thickness of 0.010 inch. The dry thickness of the layers was approximately 35 microns. Each element so prepared was twice charged, dark decayed, and exposed as in Example 1, allowing 30 seconds between the first cycle exposure and second cycle charging for dark adaptation. The ability of each element to be reused was determined by calculating its ratio of positive photodecay to the dark decay rate obtained during its second cycle. The results of this testing are summarized in Table I.

Table I

| Anhydride or Lewis acid (conc. in weight percent) | Ratio of Second Cycle Photodecay to Dark Decay | |
|---|---|---|
| | Formvar 12/85 | Pliolite S-5 |
| PA(0) | 40 | <1 |
| PA* (1.0) | 59 | 9 |
| PA (2.0) | 54 | 9.3 |
| PA (3.0) | 47 | 3.4 |
| PA (4.0) | 33 | 1.7 |
| MA (0) | 36 | <1 |
| MA (0.5) | 65 | 4 |
| MA (1.0) | 86 | 2 |
| MA (2.0) | 29 | 1 |
| MA (3.0) | 3 | <1 |
| MA (4.0) | <1 | <1 |
| TNF (0) | 40 | <1 |
| TNF (1.0) | <1 | <1 |
| TNF (2.0) | <1 | <1 |

*Code:
PA - phthalic anhydride
MA - maleic anhydride
TNF - 2,4,7-trinitro-9-fluorenone As can be seen in Table I, the beneficial effect produced with the Formvar binder together with either phthalic anhydride or maleic anhydride is dramatic when compared to similar formations, but using the Pliolite binder. Further, the Lewis acid 2,4,6-trinitro-9-fluorenone, although a well known speed sensitizer for photoconductors, impairs regeneration in the present situation.

The invention has been described in detail with particular reference to certain preferred embodiments thereof, but it will be understood that variations and modifications can be effected within the spirit and scope of the invention.

There is claimed:

1. A photoconductive and radioconductive insulating composition comprising tetragonal lead monoxide, a binder selected from the group consisting of polyvinylacetate, polyvinylformal and polyvinylbutyral and an anhydride capable of inhibiting dark conductivity in the composition, said anhydride present in effective amount less than about 4 percent of the weight of the lead oxide in the composition.

2. A photoconductive and radioconductive insulating composition comprising tetragonal lead monoxide, a binder selected from the group consisting of polyvinylacetate, polyvinylformal and polyvinylbutyral and, in an amount that ranges from about 0.5 to about 4 percent of the weight of the lead oxide, an anhydride capable of inhibiting dark conductivity within the element and being an anhydride derived from an $\alpha,\beta$-dicarboxyl substituted compound or an $\alpha$-carboxyl-$\beta$-hydroxy substituted compound.

3. A photoconductive and radioconductive insulating composition as described in claim 2 wherein the anhydride is derived from an $\alpha,\beta$-dicarboxylic acid.

4. A photoconductive and radioconductive insulating composition comprising tetragonal lead monoxide, a binder selected from the group consisting of polyvinylacetate, polyvinylformal and polyvinylbutryal and, in an amount that ranges from about 0.5 to about 4 percent of the weight of the lead oxide, an anhydride selected from the group consisting of maleic anhydride, phthalic anhydride, tetrabromophthalic anhydride, 3-nitrophthalic anhydride, naphthalic anhydride and 3,3′,4,4′-benzophenonetetracarboxylic dianhydride.

5. A photoconductive and radioconductive insulating composition comprising tetragonal lead monoxide, a binder selected from the group consisting of polyvinylacetate, polyvinylformal and polyvinylbutyral and, in an amount that ranges from about 0.5 to about 4 percent of the weight of the lead oxide, an anhydride selected from the group consisting of a phthalic anhydride and a maleic anhydride.

6. An electrophotographic and electroradiographic element comprising an electrically conducting support having thereon a photo- and radioconductive insulating composition as described in claim 1.

7. An electrophotographic and electroradiographic element comprising an electrically conducting support having thereon a photo- and radioconductive insulating composition as described in claim 2.

8. An electrophotographic and electroradiographic element comprising an electrically conducting support having thereon a photo- and radioconductive insulating composition as described in claim 4.

9. An electrophotographic and electroradiographic element comprising an electrically conducting support having thereon a photo- and radioconductive insulating composition as described in claim 5.

* * * * *